US012140057B2

(12) United States Patent
Lahr

(10) Patent No.: US 12,140,057 B2
(45) Date of Patent: Nov. 12, 2024

(54) VALVE TRAIN FOR AN INTERNAL COMBUSTION ENGINE, IN PARTICULAR OF A MOTOR VEHICLE, AS WELL AS AN INTERNAL COMBUSTION ENGINE FOR A MOTOR VEHICLE

(71) Applicant: Daimler Truck AG, Leinfelden-Echterdingen (DE)

(72) Inventor: Matthias Lahr, Schwaebisch Gmuend (DE)

(73) Assignee: Daimler Truck AG, Leinfelden-Echterdingen (DE)

( * ) Notice: Subject to any disclaimer, the term of this patent is extended or adjusted under 35 U.S.C. 154(b) by 0 days.

(21) Appl. No.: 18/549,499

(22) PCT Filed: Mar. 7, 2022

(86) PCT No.: PCT/EP2022/055666
§ 371 (c)(1),
(2) Date: Sep. 7, 2023

(87) PCT Pub. No.: WO2022/194584
PCT Pub. Date: Sep. 22, 2022

(65) Prior Publication Data

US 2024/0301809 A1 Sep. 12, 2024

(30) Foreign Application Priority Data

Mar. 17, 2021 (DE) ..... 10 2021 001 427.8

(51) Int. Cl.
*F01L 13/06* (2006.01)
*F01L 3/10* (2006.01)
*F01L 13/00* (2006.01)

(52) U.S. Cl.
CPC ..... *F01L 13/06* (2013.01); *F01L 3/10* (2013.01); *F01L 13/0036* (2013.01)

(58) Field of Classification Search
CPC . F01L 3/06; F01L 3/10; F01L 13/0036; F01L 13/06; F01L 1/047; F01L 1/14
See application file for complete search history.

(56) References Cited

U.S. PATENT DOCUMENTS

2007/0028878 A1 2/2007 Persson et al.
2010/0037854 A1* 2/2010 Yang ..... F02D 13/04 123/321

(Continued)

FOREIGN PATENT DOCUMENTS

DE 10 2018 122 325 A1 3/2020
EP 0 037 443 A1 10/1981
EP 2 425 105 B1 3/2012

OTHER PUBLICATIONS

PCT/EP2022/055666, International Search Report dated Jun. 21, 2022 (Two (2) pages).

(Continued)

*Primary Examiner* — Syed O Hasan
(74) *Attorney, Agent, or Firm* — Crowell & Moring LLP

(57) ABSTRACT

A valve train for an internal combustion engine includes an outlet valve, an engine brake rocker shaft that is pivotable around a pivot axis, where the outlet valve is operable by pivoting the engine brake rocker shaft during an engine braking operation of the internal combustion engine, a camshaft which has a cam via which the engine brake rocker shaft is pivotable around the pivot axis, and a spring element via which the engine brake rocker shaft is tensioned against the camshaft. The spring element is a leaf spring.

8 Claims, 5 Drawing Sheets

(56) References Cited

U.S. PATENT DOCUMENTS

| | | | | |
|---|---|---|---|---|
| 2010/0170472 | A1* | 7/2010 | Yang | F01L 1/181 123/321 |
| 2010/0186710 | A1* | 7/2010 | Persson | F01L 1/2411 123/90.39 |
| 2016/0025018 | A1* | 1/2016 | Gustafson | F01L 13/065 123/321 |
| 2019/0107011 | A1 | 4/2019 | Contarin et al. | |

OTHER PUBLICATIONS

German-language German Office Action issued in German application No. 10 2021 001 427.8 dated Nov. 16, 2021 (Six (6) pages).

* cited by examiner

VALVE TRAIN FOR AN INTERNAL COMBUSTION ENGINE, IN PARTICULAR OF A MOTOR VEHICLE, AS WELL AS AN INTERNAL COMBUSTION ENGINE FOR A MOTOR VEHICLE

BACKGROUND AND SUMMARY OF THE INVENTION

The invention relates to a valve train for an internal combustion engine, in particular of a motor vehicle. Furthermore, the invention relates to an internal combustion engine for a motor vehicle.

EP 2 425 105 B1 discloses a system for operating an engine outlet valve for engine braking. The system comprises a rocker shaft having a control fluid supply duct and an engine brake rocker arm, which is mounted pivotably on the rocker shaft. Furthermore, a cam for an engine braking operation of the engine brake rocker arm is provided. The system also comprises a spring that tensions the engine brake rocker arm into contact with the cam.

It is the object of the present invention to provide a valve train for an internal combustion engine as well as an internal combustion engine having such a valve train, so that an especially advantageous operation can be realized in an especially cost and installation space-efficient manner.

A first aspect of the invention relates to a valve train for an internal combustion engine that is preferably formed as a reciprocating piston engine or reciprocating engine, in particular of a motor vehicle. This means that the motor vehicle that is formed, for example, as an automobile, in particular as a commercial vehicle, comprises the internal combustion engine and therefore the valve train in its fully manufactured state and is drivable by means of the internal combustion engine. The internal combustion engine has, for example, an engine block, which delimits at least one combustion chamber of the internal combustion engine, at least partially, in particular directly. To this end, the motor block has, for example, at least one cylinder, which is delimited, for example, by the engine block, in particular directly. The cylinder partially delimits the combustion chamber. During a fired operation of the internal combustion engine, combustion processes take place in the combustion chamber. Exhaust gas of the internal combustion engine results from the respective combustion process, which, for example, can be discharged from the combustion chamber via at least outlet duct attached to the combustion chamber. The outlet duct is, for example, formed or delimited by a housing element of the internal combustion engine, i.e., in the housing. The housing element is, for example, designed separately to the engine block and is connected with the engine block. The housing element can in particular be a cylinder head. The engine block is, for example, a crankcase or a cylinder dome housing.

Here, the valve train has at least one gas exchange valve that is formed as an outlet valve, which is preferably attached to the combustion chamber and therefore to the outlet duct attached to the combustion chamber. The outlet valve is, for example, moveable between a closed position and at least one open position, in particular translationally and/or relative to the housing element. In the closed position, for example, the outlet valve blocks the associated outlet duct, so that no gas can flow into the outlet duct from the combustion chamber. In the open position, the outlet valve unblocks the outlet duct, so that a gas like, for example, the exhaust gas can flow out of the combustion chamber, through the outlet valve that is in the open position and into the outlet duct.

The valve train also comprises at least one engine brake rocker shaft that is pivotable around a pivot axis to which the outlet valve is allocated. By means of the engine brake rocker shaft, the outlet valve is operable by pivoting the engine brake rocker shaft during an engine braking operation of the internal combustion engine and is thereby in particular moveable out of the closed position into the open position. In other words, the outlet valve is operable or is operated during the engine braking operation of the in other words, in that the engine brake rocker shaft is pivoted around the pivot axis. Around the engine braking operation. the internal combustion engine functions or operates as an engine brake, by means of which the motor vehicle brakes and/or an excessive increase of a speed of the motor vehicle, which drives along a road with the speed, can be avoided. Expressed again in other words, the internal combustion engine is operable or is operated as an engine brake during the engine braking operation. The engine brake is preferably formed as a decompression brake. Here, it has been shown to be especially advantageous if, during the engine braking operation, combustion processes cease in the combustion chamber, so that, for example, the gas that flows out of the combustion chamber through the opened outlet valve into the outlet duct during the engine braking operation is at least mainly, in particular completely, air.

The valve train also comprises at least one camshaft, which is, for example, rotatable around an axis of rotation relative to the housing element. Here it is in particular conceivable that the engine brake rocker shaft, which is also simply referred to as the brake rocker shaft or rocker arm, can be pivoted around the pivot axis relative to the housing element. It is in particular provided that the axis of rotation is spaced apart from the pivot axis and/or runs parallel to the pivot axis. The camshaft has at least one camshaft, which is also referred to as the camshaft. The cam is rotatable around the axis of rotation relative to the housing element. By means of the cam, the engine brake rocker shaft is operable, and therefore pivotable around the pivot axis. To this end, the engine brake rocker shaft has, for example, a follower element, which is in particular in contact with the cam and then, for example, if the camshaft and therefore the cam are extended around the axis of rotation, rolls on and/or rolls off and/or slides off the cam. For example, the cam follower element is a roller that that is held rotatably around a rolling axis of rotation relative to the rocker arm basic body, for example on a rocker arm basic body of the engine brake rocker shaft.

Furthermore, the valve train comprises at least one spring element, by means of which the engine brake rocker shaft is tensioned against the camshaft, in particular against the cam, i.e., is pre-tensioned. What should in particular be understood here is that the cam follower element is tensioned against the cam and therefore against the camshaft by means of the spring element. Expressed in yet other words, the spring element provides a spring force, by means of which the engine brake rocker shaft is tensioned against the camshaft, in particular against the cam, whereby the engine brake rocker shaft, in particular the cam follower element, is held in in particular direct contact with the camshaft, in particular the cam.

In order to now be able to realize an especially advantageous operation of the valve train and therefore of the internal combustion engine overall in an especially cost and assembly-efficient manner, it is provided according to the invention that the spring element is formed as a leaf spring. In other words, the spring element is a mechanical spring which, in contrast to conventional solutions, is formed not as a helical spring, but rather as a leaf spring. The leaf spring is used for pre-tensioning the engine brake rocker shaft, in order to tension or pre-tension the engine brake rocker shaft on or against the camshaft. By means of the spring element, the engine brake rocker shaft can be held in secure contact with the camshaft, so that, for example, in particular production-related and/or assembly-related tolerances can be compensated for. The engine braking operation can therefore be realized especially advantageously. Since the spring element is now formed from a leaf spring according to the invention, the spring element can technically be manufactured especially advantageously and, however, in particular especially cost-efficiently, so that the costs of the valve train and therefore of the internal combustion engine can be kept in an especially low range The spring element can also be especially simply and therefore time and cost-efficiently mounted. In other words, in comparison to conventional solutions, a manufacturing and installation expense of the valve train can be reduced so that the costs of the valve train can be kept especially low. The leaf spring also has significantly lower installation space requirements in comparison to other spring types like, for example, helical springs, so that the installation space requirements of the valve train can be kept in an especially low range. The leaf spring also has a simpler manufacturing design in contrast to other spring types like, for example, a helical spring, whereby the costs can be kept in an especially low range.

In order to be able to keep the costs especially low, it is preferably provided that the leaf spring is formed as a stamped or bent part, and is therefore manufactured by stamping and/or bending. The leaf spring can thereby be manufactured especially simply and therefore time and cost-efficiently in itself, whereby the costs of the valve train and therefore of the internal combustion engine can be kept especially low overall.

The previously mentioned and described outlet valve is also referred to as the first outlet valve, wherein the previously mentioned and described engine brake rocker shaft is also referred to as the first engine brake rocker shaft. Furthermore, the previously mentioned and described cam is also referred to as the first cam, and the previously mentioned and described spring element is also referred to as the first spring element, so that the previously mentioned leaf spring is also referred to as the first leaf spring.

It has been shown to be especially advantageous if the valve train has a second outlet valve, which is provided in addition to the first outlet valve. The second outlet valve is preferably attached to a second combustion chamber, wherein the previous and following statements regarding the first combustion chamber can also simply be applied to the second combustion chamber, and vice versa. It is therefore conceivable that the second combustion chamber is at least partially formed or, in particular directly, delimited by the engine block. It is in particular conceivable that the second outlet valve is attached to a second outlet duct that is provided in addition to the previously-mentioned outlet duct, wherein the second outlet duct is preferably formed by the previously-mentioned housing element or is designed in the housing element. The previous and following statements regarding the first outlet duct can therefore, for example, also simply be applied to the second outlet duct. During the fired operation of the internal combustion engine, combustion processes occur, for example, in the second combustion chamber, from which exhaust gas is produced, which can flow out of the second combustion chamber into the second outlet duct. The second outlet valve is thereby moveable between a closed position and at least one second open position, for example, in particular translationally and/or relative to the housing element. In the second closed position, the second outlet valve blocks the second outlet duct, so that no gas can flow out of the second combustion chamber into the second outlet duct. In the second open position, the second outlet valve, for example, unblocks the second outlet duct, so that gas can then flow out of the second combustion chamber, into the second outlet duct through the opened second outlet valve.

Here, the valve train preferably comprises a second engine brake rocker shaft that is pivotable around the pivot axis, in particular relative to the housing element, wherein the previous and following statements regarding the first engine brake rocker shaft can simply be applied to the second engine brake rocker shaft, and vice versa. By means of the second engine brake rocker shaft, the second outlet valve is actuatable during the engine braking operation of the internal combustion engine by pivoting the second engine brake rocker shaft, and is thereby in particular moveable from the second closed position into the second open position. The second engine brake rocker shaft is preferably provided in addition to the first engine brake rocker shaft. The camshaft has a second cam, which is provided in addition to the first cam. At least preferably, the second cam is also rotatable around the axis of rotation relative to the engine block or relative to the housing element. By means of the second cam, the second engine brake rocker shaft is pivotable around the pivot axis, wherein the following and previous statements regarding the first cam can preferably also be applied to the second cam and vice versa.

The valve train comprises a second, mechanical spring element, which is provided in addition to the first spring element. By means of the second spring element, the second engine brake rocker shaft, in particular its cam follower element, is tensioned against the camshaft, in particular against the second cam, wherein the previous and following statements regarding the first spring element can also simply be applied to the second spring element, and vice versa. And to be able to keep the installation space requirements and the costs of the valve train in an especially low range, it is further preferably provided that the second spring element is formed as a second leaf spring.

A further embodiment is characterized in that the leaf springs, therefore the first leaf spring and the second leaf spring, are designed integrally with each other. In other words, it is preferably provided that the first leaf spring and the second leaf spring are formed by an integral spring device or an integral spring body. The spring body is preferably formed as a spring sheet metal, so that the spring body can be formed from a metallic material, in particular from sheet metal. This in particular means that the leaf springs are formed from the same material and thereby from the same metallic material. By means of the integral embodiment of the leaf springs with each other, the following advantages can be realized: The partial number and therefore the costs of the valve train can be kept especially low. The leaf springs can also be mounted simultaneously, so that the valve train can be manufactured or mounted especially time and cost-efficiently.

In conventional solutions, a sheet metal holder having a helical spring for pre-tensioning the engine brake rocker shaft fixed to it on or opposite the camshaft is used. For each of the several, in particular six, engine brake rocker shafts, a helical spring is used here, which are formed separately from each other and must be fixed to the sheet metal holder in a captive manner, either by a clamp or screw connection or by a punch riveting process. This leads to a complicated mounting process, which can now be avoided by means of the invention. Furthermore, a helical spring has greater installation space requirements in comparison to a leaf spring, which can lead to a highly stressed spring base on the respective engine brake rocker shaft. This can now also be avoided by the invention.

In a further, especially advantageous embodiment of the invention, the leaf spring, i.e., the first leaf spring and/or the second leaf spring, is formed from a metallic material, in particular from sheet metal. The installation space requirements and the costs of the valve train can thereby be kept in an especially low range.

It has been shown to be especially advantageous if the leaf spring, i.e., the first leaf spring and/or the second leaf spring, is formed as a spring arm that has a direction of longitudinal extension which extends along its direction of longitudinal extension from a basic body, in particular of the spring device or of the spring body. The spring arm is thereby held elastically on the basic body. In other words, at least one part region of the spring arm can, for example, be elastically deformed, whereby the respective engine brake rocker shaft, i.e., the first engine brake rocker shaft and/or the second engine brake rocker shaft, can be tensioned against the camshaft, in other words against the respective cam, in an installation space and cost-efficient manner.

In order to be able to manufacture the valve train especially cost-efficiently, it is provided in further embodiments of the invention that the leaf spring, i.e., the first leaf spring and/or the second leaf spring, is fixed to a housing of the valve train via the basic body. The housing is, for example, the previously mentioned housing element and/or a housing formed separately from the housing element and provided in addition to the housing element, which can be arranged at least partially in the housing element. For example, the camshaft is arranged at least partially and rotatably in the housing. By using the basic body in order to fix the leaf spring to the housing, the valve train can be especially simply and cost-efficiently mounted or manufactured.

It has been shown to be especially advantageous if the basic body has at least one through-opening, which is preferably completely peripherally delimited by the basic body or by a change of the basic body along its peripheral direction and is therefore completely continuously closed. By means of the through-opening, the basic body and therefore the leaf spring are fixed to the housing, whereby an especially simple and therefore time and cost-efficient mounting of the valve train can be represented.

In order to be able to fix the basic body and therefore the leaf spring or the spring body especially simply, time and cost-efficiently to the housing, a screw element that goes through the through-opening, in particular a screw, is provided in a further embodiment of the invention, by means of which screw the basic body and therefore the leaf spring or the spring body is screwed together with the housing and is thereby fixed to the housing.

Finally, it has been shown to be especially advantageous if the spring arm is designed integrally with the basic body, so that the spring arm is formed from the same material. The material is preferably a or the previously mentioned metallic material, in particular sheet metal.

A second aspect of the invention relates to an internal combustion engine for a motor vehicle, which is preferably designed as a reciprocating piston engine or reciprocating engine. The internal combustion engine has at least one valve train according to the first aspect of the invention. Advantages and advantageous embodiments of the first aspect of the invention are to be regarded as advantages and advantageous embodiments of the second aspect of the invention and vice versa.

Further advantages, features and details of the invention arise from the description of a preferred exemplary embodiment below, as well as with the aid of the drawings. The features and combinations of features specified in the description above and the features and combinations of features specified in the description of the figures and/or in the figures only below can be used not only in the combination specified in each case, but also in other combinations or on their own without exceeding the scope of the invention.

DETAILED DESCRIPTION OF THE DRAWINGS

Figure 1:
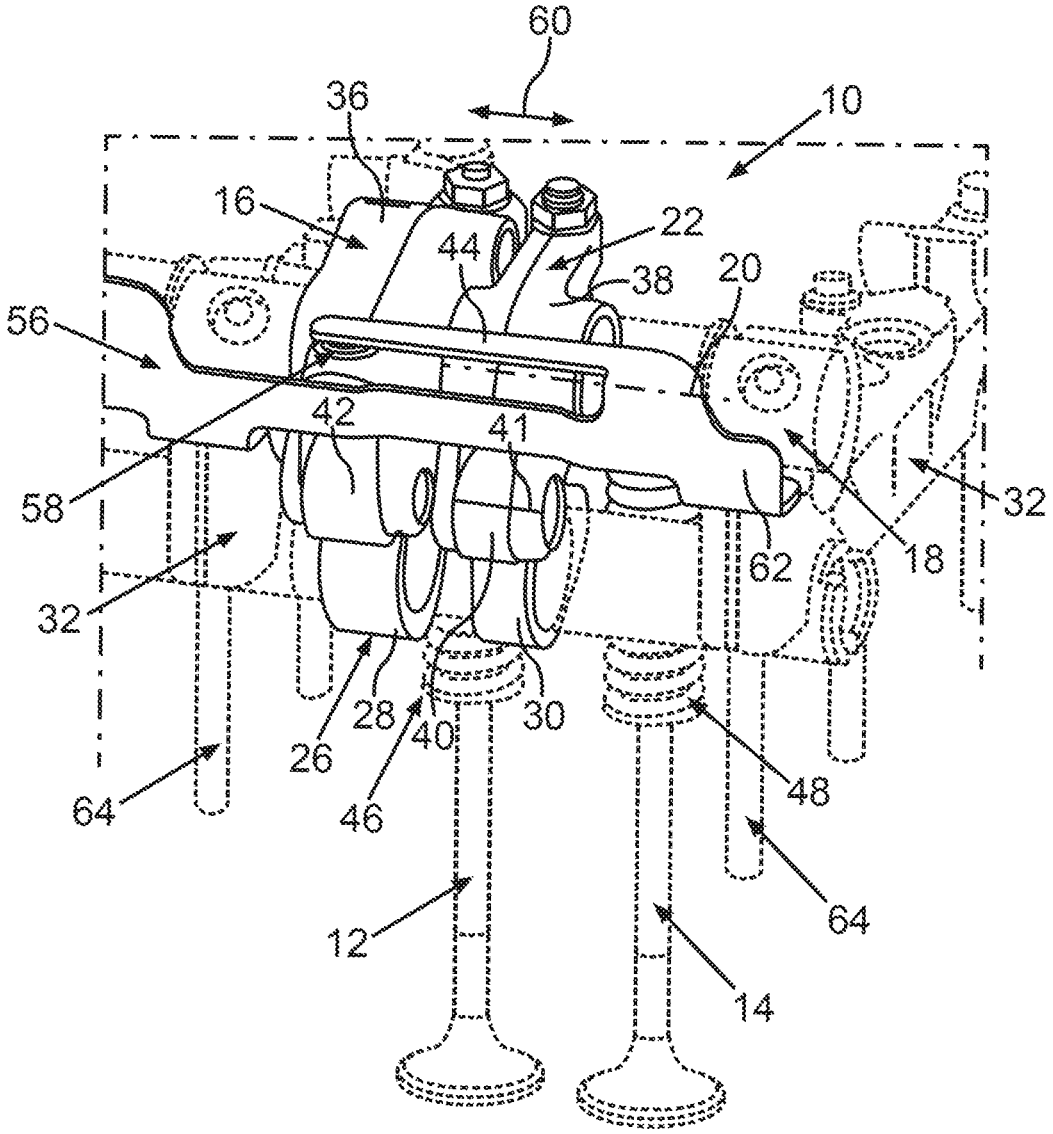
FIG. 1 is a cut-away schematic perspective view of a valve train for an internal combustion engine of a motor vehicle according to the invention.

In the figures, identical or functionally identical elements are provided with the same reference numerals.

FIG. 1 shows a valve train 10 of an internal combustion engine of a motor vehicle formed as a reciprocating piston engine or reciprocating engine in a cut-away schematic perspective view. The motor vehicle is formed as an automobile, in particular as a commercial vehicle, and comprises the internal combustion engine by means of which the motor vehicle can be driven. The internal combustion engine has an engine block, which has, i.e., in particular directly forms or delimits, several cylinders. A respective piston is received into the respective cylinder so it can move translationally. The internal combustion engine also comprises a housing element formed as a cylinder head, which is formed separately to the engine block and is connected with the engine block. The cylinder head has a combustion chamber for each cylinder, wherein the respective piston that is received in the respective cylinder so it can move translationally is delimited by means of the respective cylinder, and the respective combustion chamber roof is delimited by a respective combustion chamber of the internal combustion engine. During a fired operation of the internal combustion engine, combustion processes occur in the respective combustion chamber, wherein, during the respective internal combustion process, a fuel-air mixture is burnt. Exhaust gas of the internal combustion engine results from this. For each combustion chamber, the cylinder head has at least one outlet duct, via which the respective exhaust gas can be discharged from the respective combustion chamber. In particular, the cylinder head has at least or exactly two outlet ducts per combustion chamber. It is recognizable from FIG. 1 that two gas exchange valves formed as outlet valves 12 and 14 are attached to a first of the combustion chambers. The outlet valve 12 is attached to a first of the outlet ducts attached to the first combustion chamber, and the gas exchange valve 14 is attached to a second of the outlet ducts attached to the first combustion chamber. The respective outlet valve 12 or 14 is translationally moveable between a respective closed position and at least one respective open position, relative to the cylinder head. In the closed position, the respective outlet valve 12 or 14 blocks the respective outlet duct, which the respective outlet valve 12 or 14 is attached to. In the respective open position, however, the respective outlet valve 12 or 14 unblocks the respective outlet duct, which is attached to the respective outlet valve 12 or 14. The previous and following statements regarding the first combustion chamber, the outlet ducts attached to the first combustion chamber and the outlet valves 12 and 14 can also be simply applied to the other combustion chambers of the internal combustion engine, and vice versa.

Figure 2:
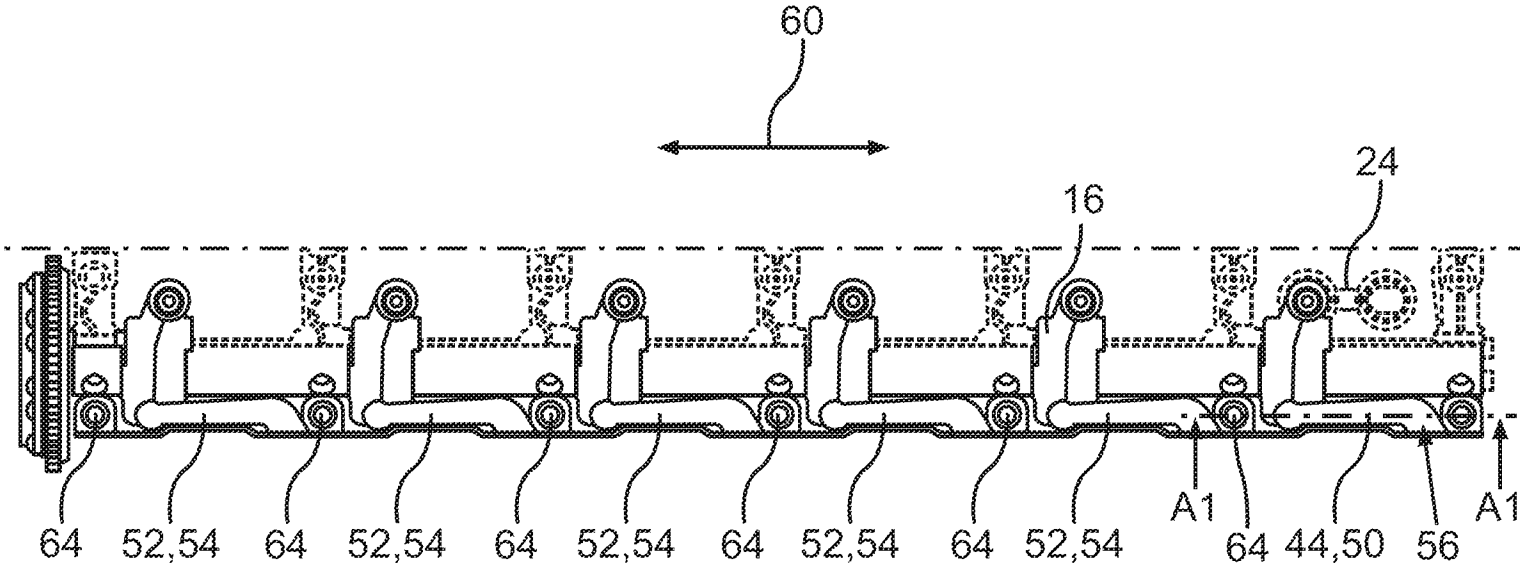
FIG. 2 is a cut-away schematic plan view of a valve train.

The outlet valve 12 is attached to an engine brake rocker shaft 16, which is mounted on a rocker shaft 18 such that the engine brake rocker shaft 16 is pivotable around a pivot axis 20 relative to the rocker shaft 18. The gas exchange valve 14 is attached to an outlet rocker arm 22, which is arranged on the rocker shaft and is pivotable around the pivot axis 20 relative to the rocker shaft 18. For example, during fired operation, the outlet valves 12 and 14 are in particular operable via a valve bridge 24 (FIG. 2), by means of the outlet rocker arm 22, therefore are moveable from the respective closed position into the respective open position, in particular while an operation of the outlet valves 12 and 14 effected by means of the engine brake rocker shaft 16 does not occur. For operating the valve bridge 24 and therefore for operating the outlet valves 12 and 14 via the valve bridge, the outlet rocker arm 22 and the pivot axis 20 would pivot relative to the rocker shaft 18 and therefore be operated. By means of the engine brake rocker shaft 18, the outlet valve 12 is operable in an engine braking operation of the internal combustion engine by means of pivoting the engine brake rocker shaft 16 and is thereby moveable out of the closed position of the outlet valve 12 into the open position of the outlet valve 12, in particular during an operation of the outlet valve 14. In other words, during the engine braking operation, the outlet valve 12 is operated by means of the engine brake rocker shaft 16, in particular during an operation of the outlet valve 14. To this end, the engine brake rocker shaft 16 is pivoted around the pivot axis 20, relative to the rocker shaft 18. During the engine braking operation, the internal combustion engine functions as an engine brake, which is in particular formed as a decompression brake. During the engine braking operation, a fired operation of the internal combustion engine does not occur, so no combustion processes occur in the combustion chamber during the engine braking operation. During the engine braking operation, a gas, which contains at least predominantly air, is introduced into the respective combustion chamber and is compressed by means of the respective piston. By means of pivoting the engine brake rocker shaft 16, the outlet valve 12 is opened such that the compressed gas is released out of the respective compressor, so that at least one predominant part of compression energy that is contained in the compressed gas is lost unused, therefore not for moving the piston out of its upper dead centre into its lower dead centre. The internal combustion engine therefore provides compression work for compressing the gas into the combustion chamber, however at least a majority part of the provided compression energy is lost and can therefore not be used in order to move the piston in its upper dead centre in the direction of its lower dead centre. Because the motor vehicle is braked in the engine braking valve or by means of the engine braking operation, an undesired excessive increase of a driving speed of the motor vehicle can be avoided.

The valve train 10 also comprises a camshaft 26, which has a first cam 28 attached to the engine brake rocker shaft 16 and a second cam 30 attached to the outlet rocker arm 22. The cams 28 and 30 are arranged coaxially to each other, wherein the camshaft 26 and therefore the cams 28 and 30 are rotatable around an axis of rotation also referred to as a camshaft axis of rotation relative to the cylinder head. The valve train 10 also comprises a camshaft housing 32, in which the camshaft 26 is at least partially arranged, wherein the camshaft 26 and therefore the cams 28 and 30 are rotatable around the camshaft axis of rotation relative to the camshaft housing 32. It is conceivable that, both during fired operation and also during engine braking operation, the outlet valves 12 and 14 are operated by means of the cam 28, in particular via the valve bridge 24, in particular such that by means of rotating the camshaft 26 and therefore by means of rotating the cam 30, the outlet rocker arm 22 is pivoted around the pivot axis 20 relative to the rocker shaft 18. It is therefore conceivable that, both during engine braking operation and also during fired operation, the outlet rocker arm 22 is operated by means of the cam 30 and therefore by means of the camshaft 26, is therefore pivoted around the pivot axis 20. By means of pivoting the outlet rocker arm 22 around the pivot axis 20, the outlet valves 14 and 12 are operated, in particular via the valve bridge 24. It is thereby conceivable that the outlet valve 12 is operated by means of the engine braking operation 16 during the engine braking operation, while an operation of the outlet valve 14 does not occur. Further, it is preferably provided that an operation of the outlet valve 12 carried out by means of the engine brake rocker shaft 16 does not occur during fired operation. However, it is conceivable that, both during engine braking operation and also during fired operation, the engine braking operation 16 is pivoted around the pivot axis 29 relative to the rocker shaft 18 by means of the cam 28 and therefore by means of the camshaft 26. In order to avoid the outlet valve 12 being operated by means of the engine brake rocker shaft 16 during the fired operation of the internal combustion engine, although the engine brake rocker shaft 16 is pivoted around the pivot axis 20 relative to the rocker shaft 18 by means of the cam 28 during the fired operation, a piston arrangement, in particular of the engine brake rocker shaft 16, can be provided.

Figure 4:
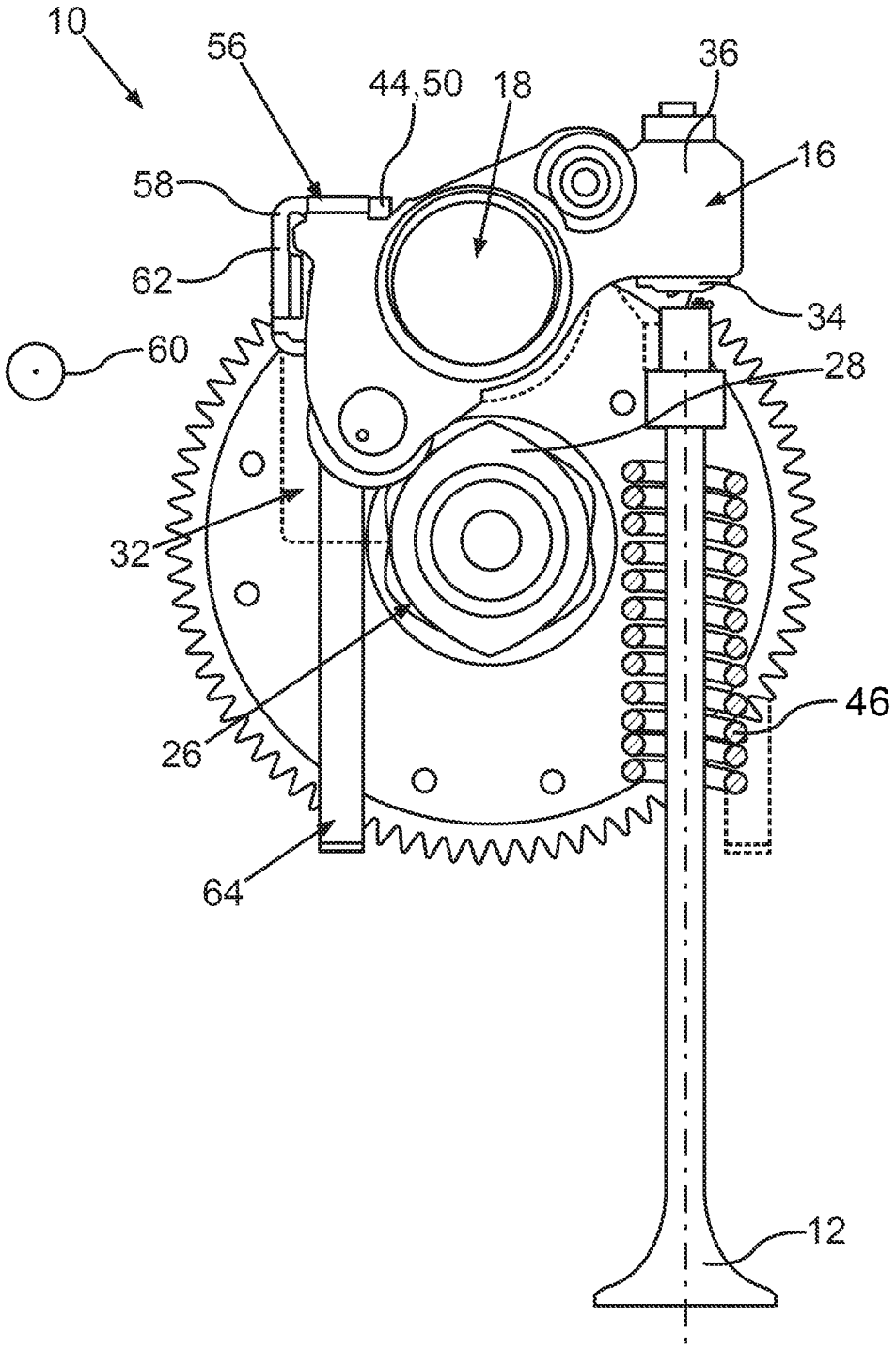
FIG. 4 is a cut-away schematic sectional view of the valve train along a sectional plane A2-A2 shown in FIG. 3.

As is in particular recognizable from FIG. 4, the piston arrangement for example comprises a hydraulic piston, also referred to as a piston 34, which is moveable between at least one retracted position shown in FIG. 4, and at least one extended position, in particular relative to a rocker arm basic body 36 of the engine brake rocker shaft 16 and/or translationally. In the retracted position, despite a pivoting of the engine brake rocker shaft 16 around the pivot axis 20, an operation of the outlet valve 12 actuated by means of the engine brake rocker shaft 16 does not occur. However, in the extended position, the engine brake rocker shaft 16 operates the outlet valve 12 if the engine brake rocker shaft 16 is moved around the pivot axis 20.

In order to, for example, move the piston 34 that is in particular formed as a hydraulic piston out of the retracted position into the extended position, a fluid, in particular a liquid, is for example inserted into a chamber that is, for example, arranged in the rocker arm basic body 36, whereby the piston 34 is acted upon at least indirectly, in particular directly by the fluid and is thereby moved out of the retracted position into the extended position. At least one longitudinal region of the piston 34 is thereby moved out of the rocker arm basic body 36, wherein, in the retracted position, the longitudinal region is received in the rocker arm basic body 36.

The outlet rocker arm 22 has a further rocker arm basic body 38. In order to advantageously actuate the outlet rocker arm 22 by means of the attached or associated cam 30 and therefore to be able to pivot it, the outlet rocker arm 22 has a cam follower element formed as a roller 40, which is held on the rocker arm basic body 38 so as to be rotatable around an axis of rotation 41, relative to the rocker arm basic body 38 and then, if the camshaft 26 and therefore the cam 30 are rotated, it rolls on and/or rolls off the cam 30. The outlet rocker arm 22 is thereby operated via its roller 40 by means of the cam 30, i.e., is pivoted. The engine brake rocker shaft 16 correspondingly has a cam follower element formed as a part 42, which is held on the rocker arm basic body 36 so as to be rotatable around a roller axis of rotation, which for example coincides with the axis of rotation 41, relative to the rocker arm basic body 36. If the camshaft 26 and therefore the cam 28 are rotated around the camshaft axis of rotation relative to the cylinder head, then the roller 42 rolls off a cam 28, whereby the engine brake rocker shaft 16 is operated via its roller 42, therefore is pivoted. It is therefore recognizable that, by means of the cam 28, the engine brake rocker shaft 16 is pivotable around the pivot axis 20.

The valve train 10 furthermore has a spring element 44, by means of which the engine brake rocker shaft 16, in particular its roller 42, is tensioned against the camshaft 26, in particular against the cam 28. This in particular means that the engine brake rocker shaft 16, in particular its roller 42, is held in contact, in particular in direct contact, with the camshaft 26, in particular the cam 28, by means of the spring element 44. To this end, the spring element 44, which is a mechanical spring here, for example provides a spring force, by means of which the engine brake rocker shaft 16, in particular the roller 42, is tensioned against the camshaft 26, in particular against the cam 28.

It is furthermore recognizable that the respective outlet valve 12 or 14 is attached to a respective valve spring 46 or 48. If the respective outlet valve 12 or 14 moves out of its respective closed position into its respective open position, then the respective valve spring 46 or 48 is thereby tensioned, in particular compressed. The respective valve spring 46 or 48 therefore provides a spring force, at least in the respective open position of the respective outlet valve 12 or 14, by means of which the respective outlet valve 12 or 14 is moveable into the respective closed position and in particular should be held in the respective closed position.

In order to now be able to keep the installation space requirements and the costs of the valve train 10 and therefore of the internal combustion engine especially low overall, it is provided that the mechanical spring element 44 is formed as a leaf spring 50.

Because—as previously described—the internal combustion engine has multiple combustion chambers, the valve train 10 has multiple outlet valves and multiple attached engine brake rocker shafts, such as the engine brake rocker shaft 16. The previous and following statements regarding the engine brake rocker shaft 16 can thus also simply be applied to the other engine brake rocker shaft and vice versa. Consequently, the valve train 10 has—as can be recognized from FIG. 2—the spring element 44 formed as the leaf spring 50 as well as further, mechanical spring elements 52, to which the previous and following statements regarding the spring element 44 can be applied, and vice versa. The mechanical spring elements 52 are thereby also formed as respective second leaf springs 54. By means of the respective second leaf spring 54, the associated engine brake rocker shafts are tensioned against the associated cams of the camshaft 26, whereby tolerances can be compensated for in a cost and installation space-efficient manner. It is provided that the leaf spring 50 and 54 are designed integrally with each other. This means that the leaf springs 50 and 54 are formed by an integral spring body 56, which is here formed as a spring plate or is formed from a spring plate. The number of parts and therefore the installation space requirements and the costs of the valve train 10 can thereby be kept especially low, since in particular all leaf springs 50 and 54 can be mounted simultaneously. It is further preferably provided that the spring body 56 and therefore the leaf springs 50 and 54 are formed from a metallic material, in particular from sheet metal, whereby the costs can be kept in an especially low range.

It is recognizable from FIG. 1 that the engine brake rocker shaft 16 can have a spring support 58, which can, for example, be designed integrally with the rocker arm basic body 36, or can be formed by the rocker arm basic body 36. It is further conceivable that the spring support 58 is designed separately to the rocker arm basic body 36 and is connected with the rocker arm basic body 36. It is in particular conceivable that the spring support 58 is held on the rocker arm basic body 36 so as to be moveable relative to the rocker arm basic body 36, in particular translationally. The spring support 58 can thereby, for example, be moved along a direction of movement relative to the rocker arm basic body 36, in particular translationally, in particular while the spring support 58 is held on the rocker arm basic body 36 or is connected with the rocker arm basic body 36. It is in particular conceivable that the leaf spring 50 is supported on the spring support 58 in the direction of movement, in particular directly. By moving the spring support 58 relative to the rocker arm basic body 36 along the direction of movement, it is possible to set a distance between a support surface of the spring support 58 and the rocker arm basic body 36 that in particular runs along the direction of movement, wherein the leaf spring 50 is supported, in particular directly, on the support surface, in particular rests on or against the support surface. By setting the distance between the support surface and the rocker arm basic body 36, a tensioning of the engine brake rocker shaft 16 against the cam 28, which is effected by means of the leaf spring 50, can, for example, be set, so in other words, the spring force provided by the leaf spring 50, by means of which the engine brake rocker shaft 16 is tensioned against the camshaft 26, in particular against the cam 28, can thereby, for example, be set.

In the exemplary embodiment shown in Figures, the respective leaf spring 50 or 54 is designed as a spring arm, which has a direction of longitudinal extension that is illustrated by a double-headed arrow 60 in FIG. 1. The spring arm extends from a basic body 62 of the spring body 56 along its direction of longitudinal extension, so that the spring arm and the basic body 62 components of the spring body 56 are formed by the spring body 56. The spring arm is designed integrally with the basic body 62. Since the spring arm extends from the basic body 62, the spring arm is held elastically on the basic body 62 or is connected elastically to the basic body 62, whereby the engine brake rocker shaft 16 can be tensioned against the cam 28 especially advantageously.

Figure 3:
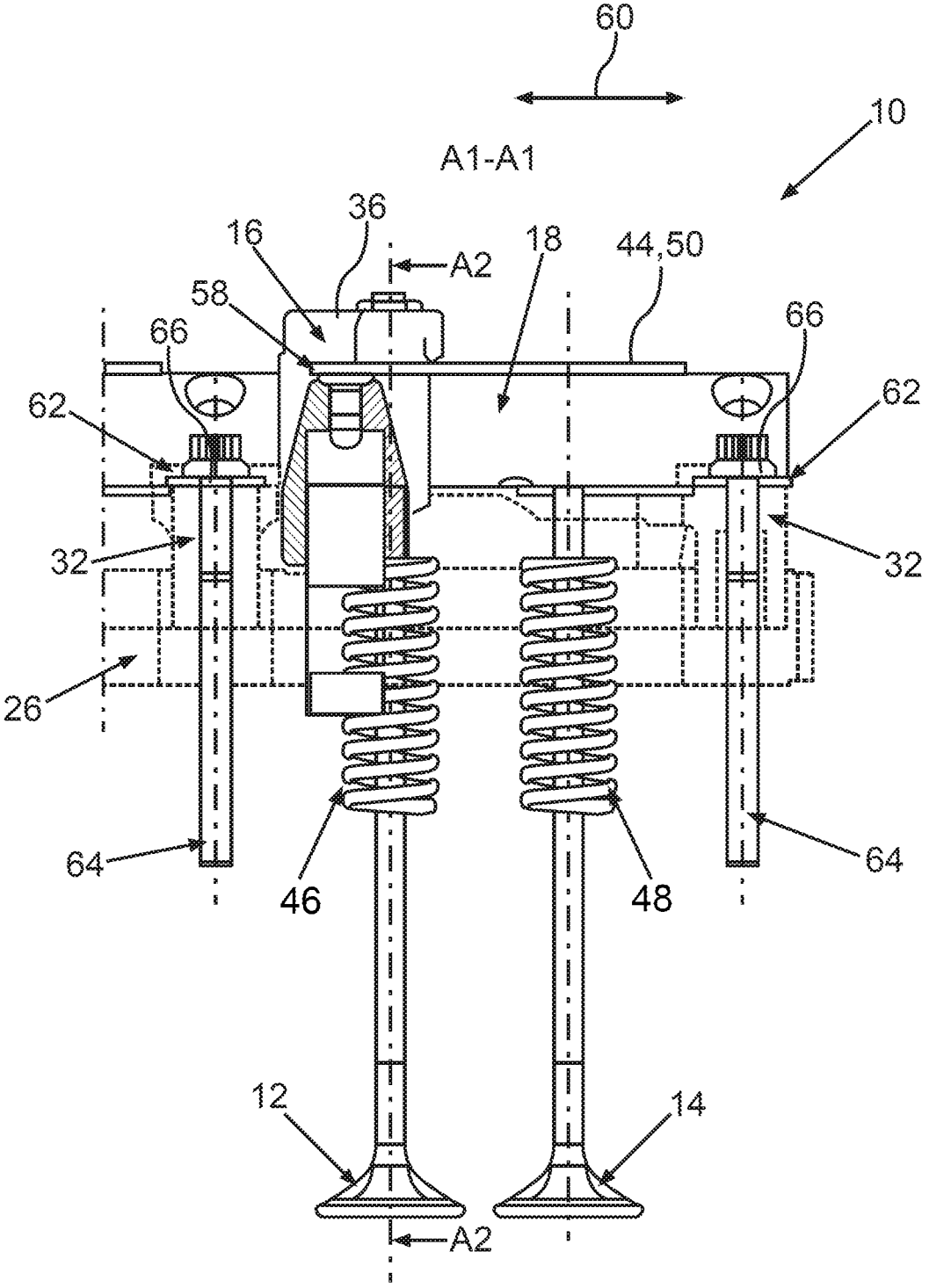
FIG. 3 is a cut-away schematic sectional view of the valve train along a sectional plane A1-A1 shown in FIG. 2.

The leaf springs 50 and 54 are fixed to a housing such as, for example, the cylinder head and/or the camshaft housing 32, via the basic body 62, which is designed integrally with the leaf springs 50 and 54. To this end, screw elements formed as screws 64 are provided—as is recognizable from FIG. 2. The respective screw 64 goes through a corresponding through-opening of the basic body 62, the respective through-opening of which is completely peripherally delimited by the basic body 62 or by a change of the basic body 62 in the peripheral direction of the respective through-opening. By means of the screw 64 going through the through-opening of the by means of 62, the spring bodies 56 and thereby the basic bodies 62 and therefore the leaf springs 50 and 54 are screwed to the housing and are thereby fixed to the housing. Two of the through-openings of the basic body 62 are recognizable in FIG. 3 and are labelled with 66 there.

Figure 5:
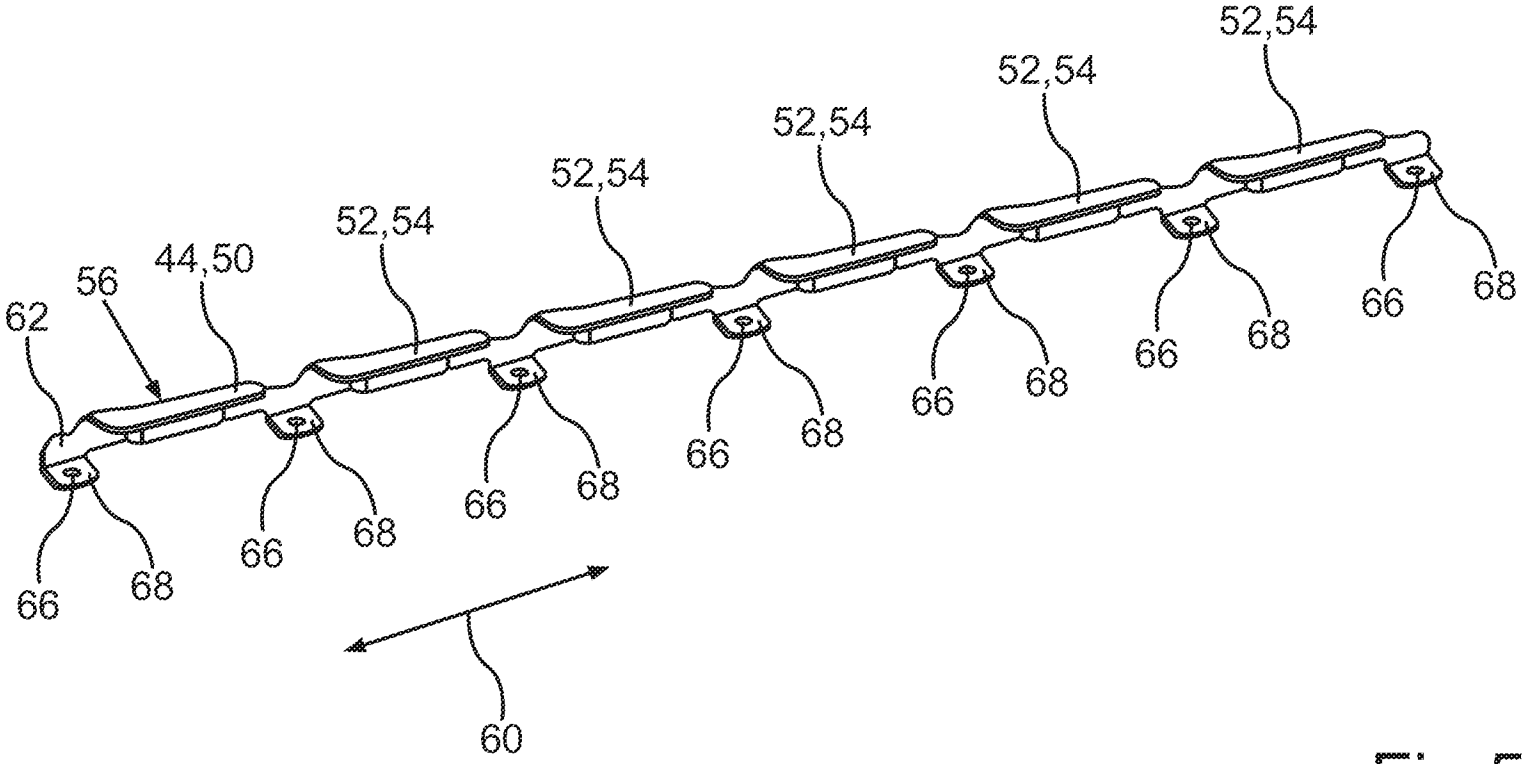
FIG. 5 is a schematic perspective view of a spring body of the valve train designed as a spring plate.

FIG. 5 shows the integral spring body 56 with its basic body 62 and the leaf springs 50 and 54 in a schematic perspective view. It can be seen especially clearly from FIG. 5 that the through-openings 66 are designed in respective flaps 68, which are designed integrally with the basic body 62 and extend along a spacing direction from the basic body 62, wherein the spacing direction runs diagonally or perpendicularly to the direction of longitudinal extension of the respective leaf spring 50 or 54. The integral spring body 56 can be mounted especially simply and therefore time and cost-efficiently, whereby a simultaneous mounting of the leaf springs 50 and 54 occurs. The valve train 10 can therefore be especially simply and therefore time and cost-efficiently manufactured or mounted. In order to keep the costs especially low, the spring body 56 is preferably designed as a stamped and bent part, in particular as a sheet metal stamped and bent part, so that the spring body 56 is preferably manufactured by stamping and bending as well as preferably being formed from sheet metal.

LIST OF REFERENCE CHARACTERS

10 valve train
12 outlet valve
14 outlet valve
16 engine brake rocker shaft
18 rocker shaft
20 pivot axis
22 outlet rocker arm
24 valve bridge
26 camshaft
28 cam
30 cam
32 camshaft housing
34 piston
36 rocker arm basic body
38 rocker arm basic body
40 roller
41 axis of rotation
42 roller
44 spring element
46 valve spring
48 valve spring
50 leaf spring
52 spring element
54 leaf spring
56 spring body
58 spring support
60 dual arrow
62 basic body
64 screw
66 through-opening
68 flap

The invention claimed is:

1. A valve train for an internal combustion engine, comprising: a first outlet valve; a first engine brake rocker shaft that is pivotable around a pivot axis, wherein the first outlet valve is operable by pivoting the first engine brake rocker shaft during an engine braking operation of the internal combustion engine; a camshaft which has a first cam via which the first engine brake rocker shaft is pivotable around the pivot axis; a first spring element via which the first engine brake rocker shaft is tensioned against the camshaft; wherein the first spring element is a first leaf spring for a first cylinder, a second outlet valve; a second engine brake rocker shaft that is pivotable around the pivot axis, wherein the second outlet valve is operable by pivoting the second engine brake rocker shaft during the engine braking operation of the internal combustion engine; wherein the camshaft has a second cam via which the second engine brake rocker shaft is pivotable around the pivot axis; a second spring element via which the second engine brake rocker shaft is tensioned against the camshaft; wherein the second spring element is a second leaf spring for a second cylinder, and wherein the first leaf spring and the second leaf spring are designed integrally with each other.

2. The valve train according to claim 1, wherein the first leaf spring is formed from a metallic material.

3. The valve train according to claim 1, wherein the first leaf spring is formed as a spring arm which extends from a basic body along a direction of longitudinal extension.

4. The valve train according to claim 3, wherein the first leaf spring is fixed to a housing of the valve train via the basic body.

5. The valve train according to claim 4, wherein the basic body has a through-opening via which the basic body is fixed to the housing.

6. The valve train according to claim 5, further comprising a screw element that penetrates the through-opening, wherein via the screw element the basic body is screwed to the housing and thereby fixed to the housing.

7. The valve train according to claim 3, wherein the spring arm is designed integrally with the basic body.

8. An internal combustion engine for a motor vehicle, comprising: the valve train according to claim 1.

* * * * *